US010300705B2

(12) United States Patent
Suzuki

(10) Patent No.: US 10,300,705 B2
(45) Date of Patent: May 28, 2019

(54) FLUID EJECTION DEVICE AND CONTROL METHOD THEREFOR

(71) Applicant: SEIKO EPSON CORPORATION, Tokyo (JP)

(72) Inventor: Tomoji Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/577,548

(22) PCT Filed: May 31, 2016

(86) PCT No.: PCT/JP2016/002628
§ 371 (c)(1),
(2) Date: Nov. 28, 2017

(87) PCT Pub. No.: WO2016/199370
PCT Pub. Date: Dec. 15, 2016

(65) Prior Publication Data

US 2018/0162138 A1 Jun. 14, 2018

(30) Foreign Application Priority Data

Jun. 9, 2015 (JP) ..... 2015-116407

(51) Int. Cl.
*B41J 2/175* (2006.01)
*B41J 2/19* (2006.01)
(Continued)

(52) U.S. Cl.
CPC ..... *B41J 2/17596* (2013.01); *B41J 2/1652* (2013.01); *B41J 2/16526* (2013.01);
(Continued)

(58) Field of Classification Search
CPC .. B41J 2/1652; B41J 2/16526; B41J 2/16532; B41J 2/175; B41J 2/17563; B41J 2/19; B41J 29/38
See application file for complete search history.

(56) References Cited

U.S. PATENT DOCUMENTS 6,315,402 B1 11/2001 Kawase
2011/0080456 A1 4/2011 Shibata et al.
(Continued)

FOREIGN PATENT DOCUMENTS

JP 2000-141687 A 5/2000
JP 2009-126098 A 6/2009
(Continued)

OTHER PUBLICATIONS

International Search Report dated Aug. 30, 2016 in PCT/JP2016/002628 with English-language translation (4 pgs.).

*Primary Examiner* — Lamson D Nguyen
(74) *Attorney, Agent, or Firm* — Foley & Lardner LLP

(57) ABSTRACT

Ink consumption accompanying purging bubbles from the buffer tank is suppressed. An inkjet printer has a buffer tank disposed to an ink path that supplies ink to a printhead. A first channel connects to the buffer tank at the bottom of the ink chamber, and a second channel connects to the top of the ink chamber. To print, the first valve and second valve are open, and ink is supplied from the first channel, into which bubbles do not easily flow. To purge bubbles, the first valve closes and the maintenance unit is driven in a cleaning operation, discharging bubbles with ink from the second channel. The second valve then closes, the maintenance unit is driven to create negative pressure downstream from the second valve, and the second valve then opens in a choke cleaning operation that discharges ink with entrained bubbles at once.

12 Claims, 3 Drawing Sheets

(51) Int. Cl.

| | |
|---|---|
| ***B41J 2/165*** | (2006.01) |
| ***B41J 29/38*** | (2006.01) |
| *B41J 2/21* | (2006.01) |

(52) U.S. Cl.

CPC ..... *B41J 2/16532* (2013.01); *B41J 2/175* (2013.01); *B41J 2/17563* (2013.01); *B41J 2/19* (2013.01); *B41J 29/38* (2013.01); *B41J 2/2117* (2013.01); *B41J 2202/01* (2013.01)

(56) References Cited

U.S. PATENT DOCUMENTS

| | | | |
|---|---|---|---|
| 2012/0127244 | A1 | 5/2012 | Suzuki |
| 2013/0229468 | A1 | 9/2013 | Suzuki |

FOREIGN PATENT DOCUMENTS

| | | | |
|---|---|---|---|
| JP | 2010-000626 | A | 1/2010 |
| JP | 2011-079169 | A | 4/2011 |
| JP | 2012-111096 | A | 6/2012 |
| JP | 2012-236335 | A | 12/2012 |
| JP | 2013-244682 | A | 12/2013 |

| | VALVE OPERATOR | FIRST VALVE | SECOND VALVE |
|---|---|---|---|
| FIRST STATE | FIRST POSITION 34A | OPEN | OPEN |
| SECOND STATE | SECOND POSITION 34B | CLOSED | OPEN |
| THIRD STATE | THIRD POSITION 34C | OPEN | CLOSED |

FLUID EJECTION DEVICE AND CONTROL METHOD THEREFOR

TECHNICAL FIELD

The present invention relates to a fluid ejection device having a buffer tank disposed between a cartridge storing fluid, and a fluid ejection head.

BACKGROUND

Inkjet printers having a buffer tank between the ink cartridge and printhead, temporarily storing ink in the buffer tank, and printing by supplying ink from the buffer tank to the printhead, are known from the literature. JP-A-2010-626, for example, describes an inkjet printer (fluid ejection device) of this type.

CITATION LIST

Patent Literature

[PTL 1] JP-A-2010-626

SUMMARY OF INVENTION

Technical Problem

To enable replacing the cartridge without stopping the fluid ejection operation when the fluid in the cartridge runs out in a fluid ejection device having a buffer tank, a buffer tank with a large storage capacity may be used.

When replacing the cartridge in a fluid ejection device having a buffer tank, for example, bubbles may become entrained with the fluid fed into the buffer tank. As fluid is ejected over a long period of time, bubbles flowing in from the cartridge side may accumulate in the buffer tank. When bubbles in the buffer tank then flow out to the fluid ejection head side, the bubbles enter the fluid ejection nozzles and can cause ejection problems.

To prevent ejection problems resulting from bubbles in the buffer tank, devices of the related art execute a cleaning operation that discharges (purges) bubbles from the buffer tank. However, because the bubbles gather in the top of the buffer tank, the fluid path from the buffer tank to the fluid ejection head is connected to a position where bubbles in the buffer tank cannot easily flow into the ink channel. This means that to discharge the bubbles from the buffer tank in the cleaning operation, substantially all of the fluid in the buffer tank must be discharged. As a result, when the buffer tank has a large capacity, that much fluid is consumed in the cleaning operation executed to purge bubbles. This wastes a large amount of fluid.

With consideration for the foregoing problem, the present invention provides a fluid ejection device, and a control method for a fluid ejection device, able to suppress fluid consumption in conjunction with purging bubbles from the buffer tank.

Solution to Problem

To solve the foregoing problem, a fluid ejection device according to the invention has: a fluid ejection head; a buffer tank configured to hold fluid to supply to the fluid ejection head; a fluid storage unit configured to supply the fluid to the buffer tank; a first channel connecting the buffer tank and the fluid ejection head; a second channel connected to the buffer tank and merging with the first channel; and a channel switching mechanism configured to change between a first state in which the fluid flows from the buffer tank to the first channel, and a second state in which the fluid does not flow from the buffer tank to the first channel.

This aspect of the invention has a first channel and a separate second channel connected to the a buffer tank, and fluid in the buffer tank can be switched between a first state in which the fluid flows to the first channel, and a second state in which the fluid does not flow to the first channel. Because this enables connecting the second channel to a position from where collected bubbles can easily flow into the second channel, the ink path can be changed to the second state (the state in which fluid flows from the second channel, not the first channel) to purge bubbles, and bubbles can be purged efficiently, consuming little fluid. When ejecting fluid, the ink path can be changed to the first state (the state flowing fluid to the first channel), and accumulated bubbles flowing to the fluid ejection head can be avoided.

In the invention, the channel switching mechanism preferably has a first valve disposed to the first channel on the upstream side of the junction where the second channel merges with the first channel, and a second valve disposed downstream from the junction; both the first valve and the second valve are open in the first state; and the first valve is closed, and the second valve is open, in the second state.

This configuration enables changing the outflow path of fluid by opening and closing valves.

Further preferably in the invention, the channel switching mechanism includes a motor, and a valve operator that moves to a first position, second position, or third position by motor rotation; the first valve and the second valve open when the valve operator moves to the first position; the first valve closes and the second valve opens when the valve operator moves to the second position; and the first valve opens and the second valve closes when the valve operator moves to the third position.

This configuration enables sliding a single valve operator to change the open and closed states of the two valves according to the position of the valve operator. A compact, easily controlled channel switching mechanism can therefore be provided.

A fluid ejection device according to another aspect of the invention preferably also has a maintenance mechanism configured to suction the fluid from the fluid ejection head; and a controller configured to control the channel switching mechanism and the maintenance mechanism. The controller changes the channel switching mechanism to the first state, and supplies the fluid from the buffer tank through the first channel to the fluid ejection head, to eject fluid; and executes a bubble purging process that discharges bubbles from the buffer tank at a predetermined timing, and in the bubble purging process, changes the channel switching mechanism to the second state, and executes a cleaning operation that suctions the fluid from the fluid ejection head by the maintenance mechanism; and then changes the channel switching mechanism to the third state closing the second valve, reduces the pressure on the downstream side of the second valve by the maintenance mechanism, and then executes a choke cleaning operation opening the second valve.

Thus configured, accumulated bubbles can be prevented from flowing from the first channel to the fluid ejection head when ejecting fluid. When purging bubbles, bubbles can be efficiently sent to the second channel, and bubbles in the second channel can then be purged in the choke cleaning operation. Bubbles can therefore be efficiently purged.

Another aspect of the invention preferably also has a filter disposed to the second channel.

Thus comprised, bubbles flowing into the second channel stop at the filter. Therefore, bubbles in the buffer tank can be expelled to the second channel, the expelled bubbles collected inside the second channel, and fluid alone can be supplied to the fluid ejection head. Furthermore, because the bubbles pass through the filter when a power cleaning operation, such as the choke cleaning operation, executes, bubbles can be discharged from the fluid ejection head. Bubbles can therefore be purged without providing a valve or other mechanism for opening and closing the second channel.

Further preferably, the buffer tank includes a fluid chamber, a diaphragm closing the top of the fluid chamber, and an urging member that urges the diaphragm toward the bottom of the fluid chamber.

This configuration enables pressurizing the fluid chamber, and can therefore feed fluid to the fluid ejection head side.

Further preferably, the second channel is connected to the top part of the fluid chamber.

Because this configuration connects the second channel to a position where bubbles collect in the buffer tank, collected bubbles can be efficiently expelled.

Further preferably, the cross sectional area of the second channel is smaller than the cross sectional area of the first channel.

The speed of fluid flowing through the second channel is greater than the speed of fluid flowing through the first channel. Bubbles can therefore be quickly discharged.

Another aspect of the invention is a control method of a fluid ejection device having a fluid ejection head; a buffer tank configured to hold fluid to supply to the fluid ejection head; a fluid storage unit configured to supply the fluid to the buffer tank; a first channel connecting the buffer tank and the fluid ejection head; a second channel connected to the buffer tank and merging with the first channel; a first valve disposed to the first channel on the upstream side of the junction where the second channel merges with the first channel; and a second valve disposed downstream from the junction; the control method comprising executing a bubble purging process that discharges bubbles from the buffer tank at a predetermined timing, the bubble purging process including a cleaning operation that closes the first valve, opens the second valve, and suctions fluid from the fluid ejection head, and a choke cleaning operation that closes the second valve, reduces the pressure on the downstream side of the second valve, and then opens the second valve.

When purging bubbles, this configuration enables efficiently sending bubbles to the second channel, and bubbles in the second channel can then be purged in the choke cleaning operation. Bubbles can therefore be efficiently purged.

The control method preferably includes a fluid ejection process that opens both the first valve and the second valve, flows the fluid from the buffer tank to the first channel, and supplies the fluid to the fluid ejection head.

When ejecting fluid, this configuration can prevent accumulated bubbles from flowing from the first channel to the fluid ejection head.

DESCRIPTION OF EMBODIMENTS

A fluid ejection device, and a control method of a fluid ejection device, according to the invention are described below.

General Configuration

Figure 1:
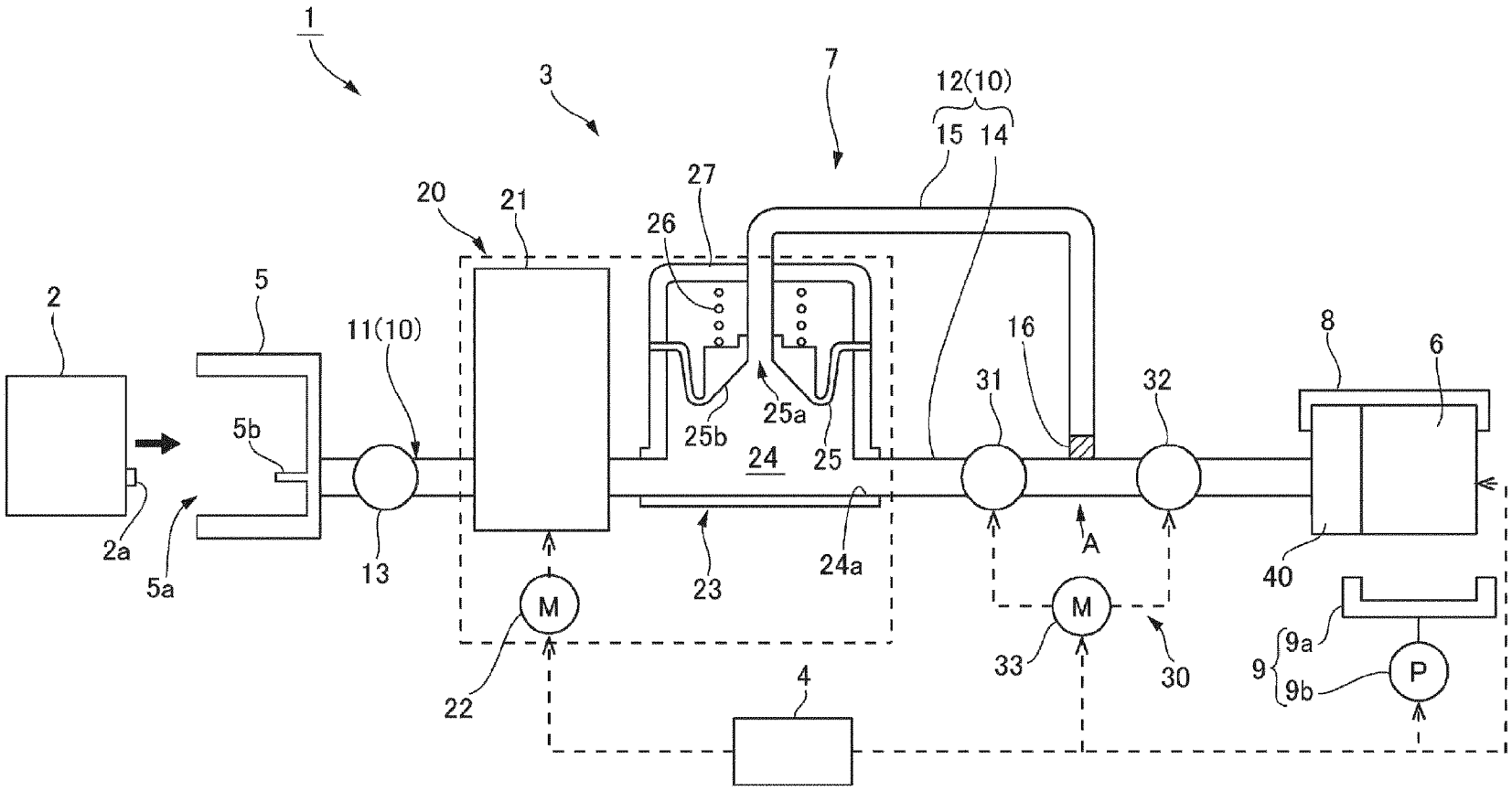
FIG. 1 schematically illustrates the configuration of an inkjet printer according to the invention.

FIG. 1 illustrates the configuration of a fluid ejection device according to the invention. The fluid ejection device in this example of the invention is an inkjet printer 1. The inkjet printer 1 prints on recording paper using multiple types of ink, and comprises a case (not shown in the figure), a print mechanism 3 housed inside the case, and a controller 4 that controls the print mechanism 3.

The print mechanism 3 includes a cartridge holder 5, printhead 6 (fluid ejection head), an ink supply system 7 for supplying ink to the printhead 6, a carriage 8 that carries the printhead 6, and a maintenance unit 9 (maintenance mechanism). The carriage 8 moves bidirectionally crosswise to the conveyance direction of the recording paper by means of a carriage drive mechanism not shown. In addition to the foregoing, the print mechanism 3 has a conveyance mechanism and a paper supply mechanism for conveying the recording paper, both not shown in FIG. 1.

Removably installed to the cartridge holder 5 is an ink cartridge 2 (fluid storage unit). The cartridge holder 5 has a cartridge insertion opening 5*a* to which the ink cartridge 2 is inserted, and an ink supply needle 5*b*. The ink cartridge 2 has an ink supply opening 2*a* on the side facing the ink supply needle 5*b* when the ink cartridge 2 is inserted to the cartridge holder 5. When the ink cartridge 2 is installed to the cartridge holder 5, the ink supply needle 5*b* is inserted to the ink supply opening 2*a*. As a result, the ink cartridge 2 is connected to the ink supply system 7.

The ink supply system 7 is a mechanism for supplying ink from the ink cartridge 2 to the printhead 6. The ink supply system 7 includes an ink path 10 from the ink supply needle 5*b* of the cartridge holder 5 to the printhead 6; a buffer tank unit 20 and a valve unit 30 (channel switching mechanism) disposed in the ink path 10; and a self-sealing valve 40 disposed at the connection between the ink path 10 and printhead 6. The ink path 10 includes a cartridge-side channel 11 from the ink supply needle 5*b* to the buffer tank unit 20, and a printhead-side channel 12 from the buffer tank unit 20 to the self-sealing valve 40. The valve unit 30 is disposed to the printhead-side channel 12.

The inkjet printer 1 according to this embodiment prints using multiple different inks, and has the same number of ink supply systems 7 as different inks. For example, if the inkjet printer 1 prints with six colors of ink, there are six ink supply systems 7. In this configuration, six ink cartridges 2 are installed in the cartridge holder 5. There are also six ink paths 10, and a buffer tank unit 20, valve unit 30, and self-sealing valve 40 are disposed to each ink path 10. The number of inks is not limited to six, and there may be only four (cyan, magenta, yellow, black), for example. Further alternatively, if only black ink is used, there may be only one ink supply system 7.

The buffer tank unit 20 includes a diaphragm pump 21, motor 22, and buffer tank 23. The diaphragm pump 21 suctions ink from the ink cartridge 2 and supplies the ink to the buffer tank 23. The diaphragm pump 21 has a pump chamber connected to the cartridge-side channel 11, a diaphragm closing the top opening to the pump chamber, and a suction lever connected to the diaphragm. The internal configuration of the diaphragm pump 21 is not shown in FIG. 1. The suction lever of the diaphragm pump 21 is driven by a motor 22. When ink in the ink cartridge 2 is suctioned by the diaphragm pump 21, the motor 22 is driven to move the diaphragm by means of the suction lever, creating negative pressure inside the pump chamber. This negative pressure causes ink held in the ink cartridge 2 to be suctioned through the cartridge-side channel 11 into the pump chamber of the diaphragm pump 21. A backflow prevention valve 13 is disposed to the cartridge-side channel 11, allowing ink to flow in one direction only from the ink cartridge 2 to the diaphragm pump 21.

The buffer tank 23 includes an ink chamber 24 (fluid chamber), diaphragm 25, pressurizing spring 26 (urging member), and support member 27. The diaphragm 25 closes an opening disposed at the top vertical end of the ink chamber 24. The support member 27 is located vertically above the diaphragm 25. The pressurizing spring 26 is between the support member 27 and diaphragm 25, and urges the diaphragm 25 toward the bottom of the ink chamber 24. The ink chamber 24 communicates with the pump chamber of the diaphragm pump 21. When the motor 22 of the diaphragm pump 21 is driven, negative pressure is created in the pump chamber, ink is suctioned into the pump chamber, and the suction lever of the diaphragm pump 21 is then driven to pressurize the pump chamber, ink inside the pump chamber is supplied to the ink chamber 24 of the buffer tank 23. The ink chamber 24 is pressurized by the pressure from the pressurizing spring 26, and ink introduced to the ink chamber 24 is fed to the printhead-side channel 12. Ink is thereby supplied to the printhead 6.

The printhead-side channel 12 includes a first channel 14 connected to an ink outflow port 24*a* disposed at the vertical bottom of the ink chamber 24, and a second channel 15 connected to a bubble escape port 25*a* formed in the diaphragm 25. The first channel 14 is the path from the ink outflow port 24*a* to the self-sealing valve 40. Ink in the ink chamber 24 can flow from the ink outflow port 24*a* to the first channel 14, and is supplied through the self-sealing valve 40 to the printhead 6. The ink outflow port 24*a* is located at the bottom of the ink chamber 24. Therefore, even if air bubbles flow with the ink into the ink chamber 24, the bubbles cannot easily flow into the first channel 14.

The second channel 15 is a flexible air escape tube, and merges with the first channel 14 at a junction A at a downstream point in the first channel 14. The cross sectional area of the second channel 15 is smaller than the cross sectional area of the first channel 14, and a mesh filter 16 (filter) is disposed near the junction A.

The diaphragm 25 has a taper 25*b* formed around the bubble escape port 25*a*. As a result, when bubbles flow with ink into the ink chamber 24, the bubbles collect along the taper 25*b* near the bubble escape port 25*a*. Ink in the ink chamber 24 can flow out from the second channel 15 as well as the first channel 14. Ink flowing from the second channel 15 merges into the first channel 14 at the junction A. If bubbles gathered around the bubble escape port 25*a* flow out with the ink to the second channel 15, the bubbles do not pass through the mesh filter 16 at the normal ink pressure, and therefore remain in the second channel 15.

Figure 2A:
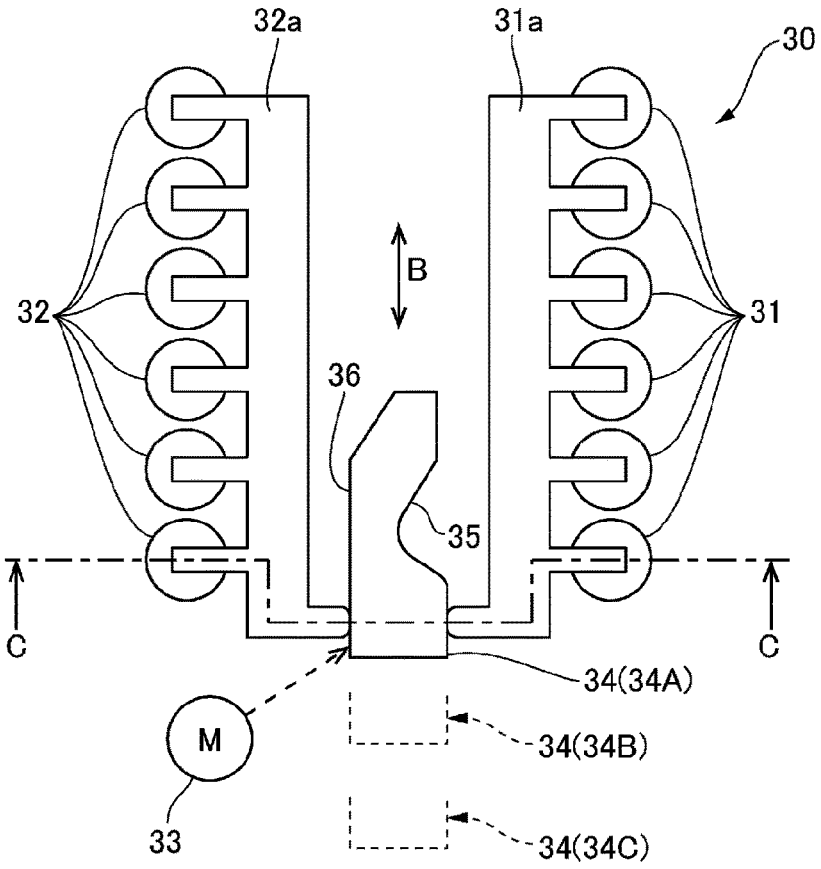
FIGS. 2A and 2B schematically illustrate the configuration of the valve unit.
Figure 2B:
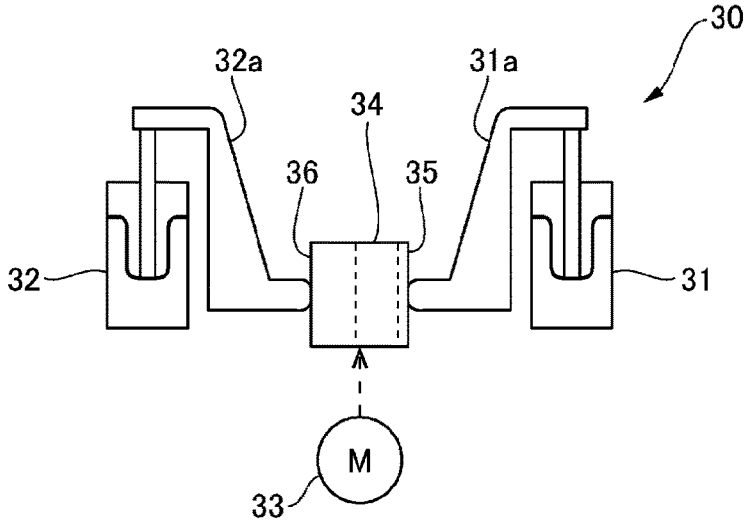

FIG. 2 illustrates the configuration of the valve unit 30, FIG. 2 (*a*) being a plan view of the valve unit 30, and FIG. 2 (*b*) being a section view of the valve unit 30 through line C-C in FIG. 2 (*a*). FIG. 2 illustrates a configuration having multiple (six in this example) ink supply systems 7, with multiple (six in this example) valve units 30 arranged in a row. As shown in FIG. 1, the valve unit 30 includes a first valve 31 between the ink outflow port 24*a* and junction A; a second valve 32 between the junction A and the self-sealing valve 40; a motor 33; and a valve operator 34 (see FIG. 2) that opens and closes the first valve 31 and second valve 32 according to the rotation of the motor 33. The first valve 31 is disposed to the first channel 14 on the upstream side of the junction A where the second channel 15 joins the first channel 14. The second valve 32 is downstream from the junction A.

As shown in FIG. 2, the valve operator 34 is disposed between the first valve 31 and second valve 32, and slides in sliding direction B perpendicularly to the direction in which the first valve 31 and second valve 32 are aligned. When there are multiple valve units 30, multiple first valves 31 and multiple second valves 32 are aligned in respective rows. The multiple sets of first valve 31 and second valve 32 are opened and closed by the valve operator 34, which is a single member.

The first valve 31 has a first lever 31*a* connected to a valving element that opens and closes the first channel 14, and the second valve 32 has a second lever 32*a* connected to a valving element that opens and closes the first channel 14. The valving element moves vertically according to the orientation of the first lever 31*a*, changing the open/closed state of the first valve 31; and the valving element moves vertically according to the orientation of the second lever 32*a*, changing the open/closed state of the second valve 32. The first lever 31*a* opens and closes multiple first valves 31 by a single member, and the second lever 32*a* opens and closes multiple second valves 32 by a single member. The valve operator 34 has a first cam surface 35 that contacts the distal end of the first lever 31*a*, and a second cam surface 36 that contacts the distal end of the second lever 32*a*. When the valve operator 34 slides in sliding direction B, the first lever 31*a* and second lever 32*a* are pushed by the first cam surface 35 and second cam surface 36, and the orientation changes. Depending on the position of the valve operator 34 in the sliding direction B, the first cam surface 35 and second cam surface 36 can change the orientation of the first lever 31*a* and second lever 32*a*. As a result, the open/closed state of the first valve 31 and second valve 32 can be changed.

Figures 3, 4:
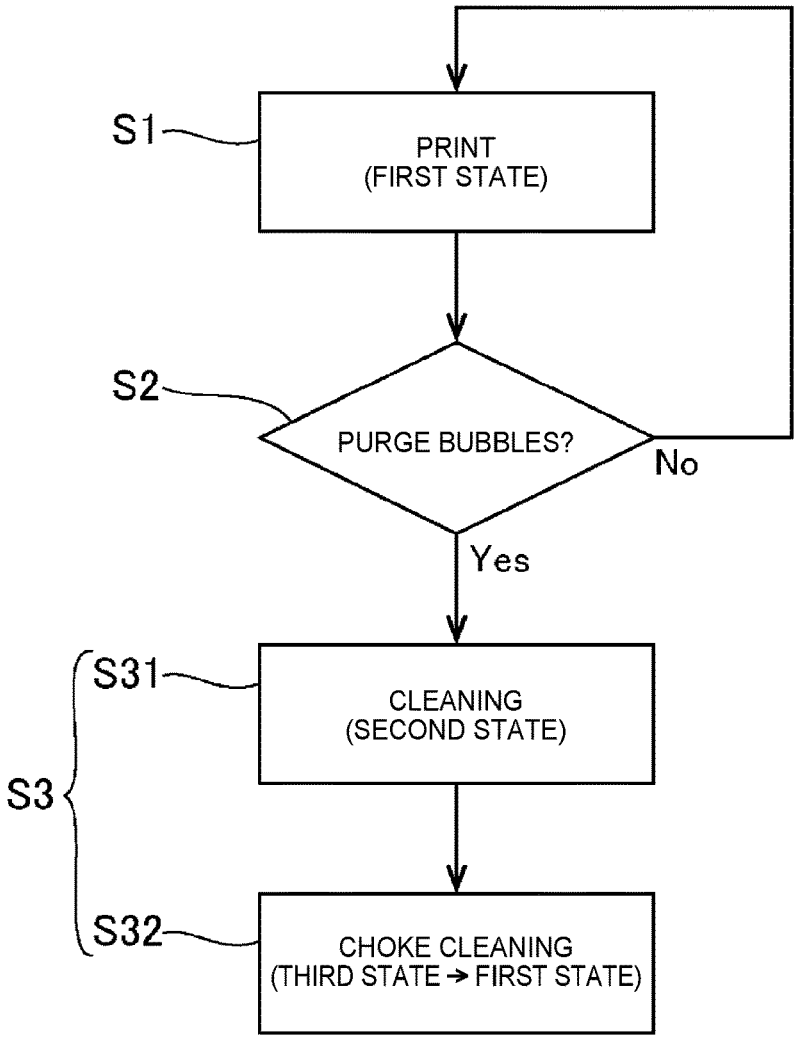
FIG. 3 is a table showing the correlation between the position of the valve operator and the open/closed position of the first valve and second valve.
FIG. 4 is a flow chart if inkjet printer control.

FIG. 3 is a table showing the relationship between the position of the valve operator 34 and the open or closed state of the first valve 31 and second valve 32. The valve operator 34 slides in sliding direction B based on rotation of the motor 33, and moves between three positions, a first position 34A, second position 34B, and third position 34C.

When the valve operator 34 moves to the first position 34A, the first valve 31 is open and the second valve 32 is open. This is the first state of the valve unit 30.

When the valve operator 34 moves to the second position 34B, the first valve 31 is closed and the second valve 32 is open. This is the second state of the valve unit 30.

When the valve operator 34 moves to the third position 34C, the first valve 31 is open and the second valve 32 is closed. This is the third state of the valve unit 30.

As shown in FIG. 1, the self-sealing valve 40 is disposed with the printhead 6 to the carriage 8. The self-sealing valve 40 is configured so that change in the ink pressure in the flow path of the printhead-side channel 12 (first channel 14) is not transferred to the ink inside the printhead (in-head path).

The maintenance unit 9 has a cap 9*a* that covers the nozzle face of the printhead 6, a lift mechanism (not shown in the figure) that moves the cap 9*a* vertically, and a suction pump 9*b*. When the printhead 6 is at the home position, which is at one end of the range of carriage 8 movement, the cap 9*a* is opposite the ink nozzle face of the printhead 6. When the cap 9*a* is covering the ink nozzle face and the suction pump 9*b* is driven to suction the inside of the cap 9*a*, negative pressure is created in the sealed space between the cap 9*a* and the nozzle face. As a result, the maintenance unit 9 can suction ink from the printhead 6 into the cap 9*a* in the cleaning operation. The ink suctioned from the printhead 6 is then recovered from the cap 9*a* into the waste ink tank not shown.

Control of the Inkjet Printer 1

As shown in FIG. 1, the inkjet printer 1 has a controller 4. The controller 4 receives print data, for example, from a host device through a communication unit not shown. Connected to the output side of the controller 4 are the printhead 6, maintenance unit 9, motor 22 that drives the diaphragm pump 21, and the motor 33 that drives the valve operator 34. A carriage drive mechanism, and conveyance mechanism, for example, are also connected to the output side of the controller 4.

FIG. 4 is a flow chart of inkjet printer 1 control. The controller 4 executes a printing step S1 including ejecting ink from the printhead 6 onto the recording paper. In the printing step S1, the controller 4 sets the valve unit 30 to the first state and supplies ink from the buffer tank 23 to the printhead 6. More specifically, the controller 4 sets the valve operator 34 to the first position 34A, and opens both first valve 31 and second valve 32. In this state, the printhead-side channel 12 communicates with the self-sealing valve 40 through both the first channel 14 connected to the ink outflow port 24*a*, and the second channel 15 connected to the bubble escape port 25*a*. Ink flowing into the first channel 14 therefore is supplied to the printhead 6 for printing. Ink also flows into the second channel 15, bubbles in the ink are trapped by the mesh filter 16, and only the ink flows into the first channel 14. In other words, ink is supplied to the printhead 6 through two channels, the first channel 14 and second channel 15.

When the printing step S1 takes a long time, bubbles may accumulate in the buffer tank 23. At a predetermined timing, the controller 4 therefore executes a bubble purging process S3 that expels bubbles from the buffer tank 23. In this example, the controller 4 executes the bubble purging process S3 approximately once every four months. The timing of the bubble purging process S3 may be previously set by a timer, for example. Alternatively, the bubble purging process S3 may be executed when ink cartridges 2 have been replaced a previously set number of times, or when the number of pages printed reaches a set threshold. When executing the printing step S1, the controller 4 executes a decision process S2 that monitors the timer, how many times the ink cartridges 2 were replaced, or the number of pages print data, for example, to determine whether or not to execute the bubble purging process S3. If the controller 4 determines it is time to execute the bubble purging process S3 (S2: Yes), it executes the bubble purging process S3.

In the bubble purging process S3, the controller 4 executes cleaning step S31 and a choke cleaning step S32. In the cleaning step S31, the controller 4 sets the valve unit 30 to the second state, and drives the maintenance unit 9 to suction ink from and clean the printhead 6. In the choke cleaning step S32, the controller 4 sets the valve unit 30 to the third state, drives the maintenance unit 9 to create negative pressure on the downstream side of the second valve 32, and then opens the second valve 32.

In the first step (cleaning step S31) of the bubble purging process S3, the controller 4 first sets the valve unit 30 to the second state. More specifically, the controller 4 drives the motor 33 to move the valve operator 34 to the second position 34B, and closes the first valve 31 on the upstream side of the junction A. As a result, ink stops flowing from the ink outflow port 24*a* to the first channel 14. Because the second valve 32 downstream from the second channel 15 is open, ink flows through the second channel 15. When the ink nozzle face of the printhead 6 is then capped with the cap 9*a*, the suction pump 9*b* is driven, and suction is applied to the inside of the cap 9*a*, ink in the buffer tank 23 flows from the second channel 15 to the printhead 6 side. At this time, bubbles accumulated near the bubble escape port 25*a* flow with the ink into the second channel 15. The bubbles pass through the mesh filter 16 due to the suction pressure of the suction pump 9*b*, and flow with the ink into the first channel 14 downstream from the second valve 32. Because the second channel 15 is has a smaller cross sectional area than the first channel 14, the speed of the ink flow when carrying bubbles from the second channel 15 is fast. As a result, the bubbles move quickly to near the self-sealing valve 40.

In the second part (choke cleaning step S32) of the bubble purging process S3, the controller 4 sets the valve unit 30 to the third state. More specifically, while ink flows with the bubbles through the second channel 15, the controller 4 drives the motor 33 to move the valve operator 34 to the third position 34C, closing the second valve 32. The controller 4 then drives the suction pump 9*b* to create suction inside the cap 9*a* covering the ink nozzle face of the printhead 6, creating a vacuum in the first channel 14 downstream from the second valve 32 where ink is holding the bubbles. The controller 4 then drives the motor 33 again to return the valve operator 34 to the first position 34A, and resets the valve unit 30 to the first state. As a result, ink flows from the second channel 15 and the upstream part of the first channel 14 to the negative pressure portion of the first channel 14 downstream from the second valve 32 in a purging action. As a result, ink containing bubbles in the portion of the first channel 14 downstream from the second valve 32 is discharged from the printhead 6 into the cap 9*a*.

The bubble purging process S3 efficiently discharges bubbles from the ink chamber 24 by means of the cleaning step S31. The choke cleaning step S32 then purges the ink and entrained air bubbles gathered near the self-sealing valve 40 from the printhead 6. By thus switching between two flow channels and executing a cleaning operation and choke cleaning operation (purging operation), bubbles can be purged from the buffer tank 23 efficiently with low ink consumption instead of discharging a large amount of ink from the ink chamber 24.

Operating Effect

As described above, an inkjet printer 1 according to this embodiment has a first channel 14 and a separate second channel 15 connected to the buffer tank 23, and can switch between a first state enabling ink in the buffer tank 23 to flow into the first channel 14, and a second state in which ink does not flow to the first channel 14. The second channel 15 is connected to a diaphragm 25, which is located at the top of the ink chamber 24 where bubbles gather. By disposing a second channel 15 separate from the first channel 14 to a position where accumulated bubbles can flow easily into the second channel 15, bubbles can be efficiently purged by switching the ink path to the second state (a state in which ink flows from the second channel 15, not the first channel 14) during the cleaning operation. When printing, the ink path is set to the first state (the state in which ink flows into the first channel 14), enabling supplying ink from the first channel 14 into which bubbles do not easily flow. The chance of bubbles mixed with the ink flowing into the printhead 6 while printing is therefore low. The chance of bubbles causing a drop in print quality is therefore also low. Bubbles in the buffer tank 23 can also be efficiently purged while using little ink.

An inkjet printer 1 according to this embodiment has a valve unit 30 (channel switching mechanism) including a first valve 31 and second valve 32, and, by opening and closing the first valve 31 and second valve 32, can change the path through which ink flows from the buffer tank 23. More specifically, the first valve 31 and second valve 32 can be opened and closed by sliding the valve operator 34 with the motor 33. The valve unit 30 connects the valving elements of multiple first valves 31 to a single first lever 31*a*, connects the valving element of multiple second valve 32 to a single second lever 32*a*, and changes the orientation of the first lever 31*a* and second lever 32*a* by pushing them with the valve operator 34. This configuration, by the reciprocating action of the valve operator 34, can synchronize opening and closing multiple sets of first valves 31 and second valves 32. A compact, easily controlled valve unit 30 can therefore be provided.

This embodiment of the invention can reliably execute the bubble purging process at the desired timing by previously setting the timing for executing the bubble purging process with a timer, for example. The bubble purging process first changes the valve unit 30 to the second state; performs a cleaning operation that suctions ink from the printhead 6 by the maintenance unit 9; then changes the valve unit 30 to the third state with the second valve 32 closed; reduces the pressure downstream from the second valve 32 by the maintenance unit 9; and then opens the second valve 32 to purge the line. This process efficiently purges bubbles from the second channel 15 by the cleaning operation, and expels the bubbles at once from the printhead 6 by the choke cleaning operation. Bubbles can therefore be efficiently discharged.

Other Embodiments

The invention is applied in the foregoing embodiment to an inkjet printer 1 having a printhead 6 that ejects ink, but the invention can be applied to fluid ejection devices that eject fluids other than ink. The invention is also applied to an inkjet printer 1 in which ink cartridges 2 (fluid storage units) are removably installed to a cartridge holder 5 (fluid supply unit), but the ink supply unit that supplies ink to the buffer tank unit 20, and ink storage unit, are not limited to the foregoing, and fluid storage units and fluid supply units of various configurations may be used.

INDUSTRIAL APPLICABILITY

As described above, the invention is useful to fluid ejection devices that eject fluid supplied through a buffer tank from a fluid storage unit, and more particularly can be applied to methods of purging bubbles from a flow channel while suppressing consumption of ink stored in a buffer tank.

REFERENCE SIGNS LIST

1 inkjet printer (fluid ejection device)
2 ink cartridge (fluid storage unit)
2*a* ink supply opening
3 print mechanism
4 controller
5 cartridge holder
5*a* cartridge insertion opening
5*b* ink supply needle
6 printhead (fluid ejection head)
7 ink supply system
8 carriage
9 maintenance unit (maintenance mechanism)
9*a* cap
9*b* suction pump
10 ink path
11 cartridge-side channel
12 printhead-side channel
13 backflow prevention valve
14 first channel
15 second channel
16 mesh filter (filter)
20 buffer tank unit
21 diaphragm pump
22 motor
23 buffer tank
24 ink chamber (fluid chamber)
24*a* ink outflow port
25 diaphragm
25*a* bubble escape port
25*b* taper
26 pressurizing spring (urging member)
27 support member
30 valve unit (channel switching mechanism)
31 first valve
31*a* first lever
32 second valve
32*a* second lever
33 motor
34 valve operator
34A first position
34B second position
34C third position
35 first cam surface
36 second cam surface
40 self-sealing valve
A junction
B sliding direction

The invention claimed is:

1. A fluid ejection device comprising:
a fluid ejection head;
a buffer tank configured to hold fluid to supply to the fluid ejection head;
a fluid storage unit configured to supply the fluid to the buffer tank;
a first channel connecting the buffer tank and the fluid ejection head;
a second channel connected to the buffer tank and merging with the first channel; and
a channel switching mechanism configured to change between a first state in which the fluid flows from the buffer tank to the first channel, and a second state in which the fluid does not flow in the first channel and flows from the buffer tank to the second channel.

2. The fluid ejection device described in claim 1, wherein:
the channel switching mechanism has a first valve disposed to the first channel on the upstream side of the junction where the second channel merges with the first channel, and a second valve disposed downstream from the junction;
both the first valve and the second valve being open in the first state; and
the first valve being closed, and the second valve being open, in the second state.

3. The fluid ejection device described in claim 2, wherein:
the channel switching mechanism includes a motor, and a valve operator that moves to a first position, second position, or third position by motor rotation;
the first valve and the second valve opening when the valve operator moves to the first position;
the first valve closing and the second valve opening when the valve operator moves to the second position; and
the first valve opening and the second valve closing when the valve operator moves to the third position.

4. The fluid ejection device described in claim 2, further comprising:
a maintenance mechanism configured to suction the fluid from the fluid ejection head; and
a controller configured to control the channel switching mechanism and the maintenance mechanism;
the controller, changing the channel switching mechanism to the first state, and supplying the fluid from the buffer tank through the first channel to the fluid ejection head, to eject fluid,
executing a bubble purging process that discharges bubbles from the buffer tank at a predetermined timing, and
in the bubble purging process, changing the channel switching mechanism to the second state, executing a cleaning operation that suctions the fluid from the fluid ejection head by the maintenance mechanism, then changing the channel switching mechanism to the third state closing the second valve, reducing the pressure on the downstream side of the second valve by the maintenance mechanism, and then executing a choke cleaning operation opening the second valve.

5. The fluid ejection device described in claim 1, further comprising a filter disposed within the second channel.

6. The fluid ejection device described in claim 1, wherein:
the buffer tank includes a fluid chamber, a diaphragm closing the top of the fluid chamber, and an urging member that urges the diaphragm toward the bottom of the fluid chamber.

7. The fluid ejection device described in claim 6, wherein:
the second channel is connected to the top part of the fluid chamber.

8. The fluid ejection device described in claim 1, wherein:
the cross sectional area of the second channel is smaller than the cross sectional area of the first channel.

9. The fluid ejection device described in claim 1, wherein:
the channel switching mechanism has a first valve disposed in the first channel;
the first valve being open in the first state; and
the first valve being closed in the second state.

10. The fluid ejection device described in claim 9, wherein:
the first valve is disposed to the first channel on the upstream side of the junction where the second channel merges with the first channel.

11. A control method of a fluid ejection device having
a fluid ejection head;
a buffer tank configured to hold fluid to supply to the fluid ejection head;
a fluid storage unit configured to supply the fluid to the buffer tank;
a first channel connecting the buffer tank and the fluid ejection head;
a second channel connected to the buffer tank and merging with the first channel;
a first valve disposed to the first channel on the upstream side of the junction where the second channel merges with the first channel; and
a second valve disposed downstream from the junction;
the control method comprising executing a bubble purging process that discharges bubbles from the buffer tank at a predetermined timing,
the bubble purging process including a cleaning operation that closes the first valve, opens the second valve, and suctions fluid from the fluid ejection head, and
a choke cleaning operation that closes the second valve, reduces the pressure on the downstream side of the second valve, and then opens the second valve.

12. The control method of a fluid ejection device described in claim 11, further comprising:
a fluid ejection process that opens both the first valve and the second valve, flows the fluid from the buffer tank to the first channel, and supplies the fluid to the fluid ejection head.

* * * * *